US008177194B2

(12) United States Patent
James

(10) Patent No.: US 8,177,194 B2
(45) Date of Patent: May 15, 2012

(54) FRANGIBLE POST FOR GUARDRAIL

(75) Inventor: Dallas James, Auckland (NZ)

(73) Assignee: Axip Limited, Auckland (NZ)

( * ) Notice: Subject to any disclaimer, the term of this patent is extended or adjusted under 35 U.S.C. 154(b) by 99 days.

(21) Appl. No.: 12/132,958

(22) Filed: Jun. 4, 2008

(65) Prior Publication Data

US 2008/0283808 A1 Nov. 20, 2008

Related U.S. Application Data

(62) Division of application No. 10/572,722, filed on Nov. 6, 2006, now Pat. No. 7,699,293.

(30) Foreign Application Priority Data

Sep. 22, 2003 (NZ) ..... 528396
Aug. 20, 2004 (NZ) ..... 534826

(51) Int. Cl.
*E01F 15/00* (2006.01)

(52) U.S. Cl. ..... 256/13.1

(58) Field of Classification Search ..... 256/13.1; 404/6–9

See application file for complete search history.

(56) References Cited

U.S. PATENT DOCUMENTS

| | | | | |
|---|---|---|---|---|
| 1,722,994 | A | | 8/1929 | Burd |
| 3,350,039 | A | | 10/1967 | Crater |
| 3,617,076 | A | | 11/1971 | Attwood et al. |
| 3,738,599 | A | | 6/1973 | Borehag |
| 3,776,520 | A | | 12/1973 | Charles et al. |
| 3,912,404 | A | * | 10/1975 | Katt ..... 403/2 |
| 3,982,734 | A | | 9/1976 | Walker |
| 4,047,702 | A | | 9/1977 | Cernia et al. |
| 4,222,552 | A | | 9/1980 | Matteo |
| 4,330,106 | A | | 5/1982 | Chisholm |
| 4,452,431 | A | | 6/1984 | Stephens et al. |
| 4,655,434 | A | | 4/1987 | Bronstad |
| 4,674,911 | A | | 6/1987 | Gertz |
| 4,678,166 | A | | 7/1987 | Bronstad et al. |
| 4,730,810 | A | | 3/1988 | Rambaud |
| 4,739,971 | A | | 4/1988 | Ruane |
| 5,022,782 | A | | 6/1991 | Gertz et al. |
| 5,039,066 | A | | 8/1991 | Stacey |
| 5,118,056 | A | | 6/1992 | Jeanise |
| 5,207,302 | A | | 5/1993 | Popp et al. |

(Continued)

FOREIGN PATENT DOCUMENTS

WO WO 96/29473 A1 9/1996

(Continued)

*Primary Examiner* — Victor MacArthur
(74) *Attorney, Agent, or Firm* — Greer, Burns & Crain, Ltd.

(57) ABSTRACT

This invention relates to guardrails and guardrail impact heads for use in roading networks or vehicle road lanes requiring separation by a barrier. The invention provides an impact head for a guardrail including cable routing means adapted to form a convoluted path through which a cable can be threaded. The convoluted path that the cables must follow through the impact head of the invention restricts movement of the cable through the head, thereby providing sufficient friction to slow down the movement of the impact head during a vehicle impact. The invention also provides a method of constructing a guardrail including the steps of slidably interconnecting a plurality of rails and attaching them to posts, positioning an impact head according to any one of the preceding claims at one end of the slidably interconnected rails, threading at least one cable through the impact head and anchoring the cable to the ground.

22 Claims, 4 Drawing Sheets

U.S. PATENT DOCUMENTS

| | | | | |
|---|---|---|---|---|
| 5,435,524 | A | 7/1995 | Ingram | |
| 5,851,005 | A | 12/1998 | Muller et al. | |
| 5,967,497 | A | 10/1999 | Denman et al. | |
| 6,065,738 | A | 5/2000 | Pearce et al. | |
| 6,065,894 | A * | 5/2000 | Wasson et al. | 403/2 |
| 6,149,134 | A | 11/2000 | Bank et al. | |
| 6,173,943 | B1 | 1/2001 | Welch et al. | |
| 6,290,427 | B1 | 9/2001 | Ochoa | |
| 6,398,192 | B1 | 6/2002 | Albritton | |
| 6,409,417 | B1 | 6/2002 | Muller et al. | |
| 6,488,268 | B1 * | 12/2002 | Albritton | 256/13.1 |
| 6,558,067 | B2 | 5/2003 | Ochoa | |
| 6,719,483 | B1 | 4/2004 | Welandsson | |
| 6,926,462 | B1 | 8/2005 | Fuganti et al. | |
| 7,086,805 | B2 | 8/2006 | Smith et al. | |
| 7,396,184 | B2 | 7/2008 | LaTurner et al. | |
| 7,445,402 | B1 | 11/2008 | Chen | |
| 7,699,293 | B2 | 4/2010 | James | |
| 7,785,031 | B2 | 8/2010 | Vellozzi et al. | |
| 2002/0179894 | A1 | 12/2002 | Albritton | |
| 2003/0222254 | A1 | 12/2003 | Bergendahl | |
| 2004/0140460 | A1 | 7/2004 | Heimbecker et al. | |
| 2005/0077507 | A1 | 4/2005 | Heimbecker et al. | |
| 2005/0077508 | A1 | 4/2005 | Bronstad | |
| 2006/0017048 | A1 | 1/2006 | Alberson et al. | |
| 2006/0054876 | A1 | 3/2006 | LaTurner et al. | |
| 2006/0102883 | A1 | 5/2006 | Troutman et al. | |
| 2007/0252124 | A1 | 11/2007 | Heimbecker | |

FOREIGN PATENT DOCUMENTS

| | | | |
|---|---|---|---|
| WO | WO 98/44203 | A1 | 10/1998 |
| WO | WO 99/32728 | A1 | 7/1999 |

* cited by examiner

FRANGIBLE POST FOR GUARDRAIL

CROSS REFERENCE TO RELATED APPLICATION

This application claims the benefit of 35 U.S.C. §120 as a Divisional Application of U.S. Ser. No. 10/572,722, filed Nov. 6, 2006 now U.S. Pat. No. 7,699,293.

TECHNICAL FIELD

This invention relates to frangible post for guardrails.

BACKGROUND ART

Existing highway guardrail end treatment systems include: the breakaway cable terminal (BCT), the eccentric loader terminal (ELT), the modified eccentric loader terminal (MELT), the vehicle attenuating terminal (VAT), the extruder terminal (ET 2000 and ET plus), the slotted rail terminal (SRT), the sequential kinking terminal (SKT) and the flared energy absorbing terminal (FLEAT).

Terminal ends (that is, the end facing oncoming traffic) generally consist of one or more, often three, W shaped (in cross-section) guardrails supported by a series of both controlled release terminal (CRT) or frangible posts and standard highway guardrail posts. Generally a cable assembly arrangement is utilised that anchors the end of the rail to the ground, transferring tensile load developed in a side-on impact by an errant vehicle to the ground anchor. Generally the terminal ends have an impact head arrangement that will be the first part impacted by an errant vehicle during an end-on impact which is designed to spread or absorb some of the impact energy.

Some terminal ends such as the abovementioned ET, SKT and FLEAT, absorb the energy of the impacting vehicle during an end on impact by having an impact head that slides down the W shaped guardrails, extruding it and breaking away the support posts as it travels down the rails. All of the other abovementioned terminal ends work on the principal of various weakening devices in the posts and rails to allow an errant vehicle to penetrate the terminal end in a controlled manner and prevent the rails from spearing the vehicle or the vehicle from vaulting or jumping over a relatively stiff terminal end.

All of the abovementioned guardrail terminal ends are considered to be gating, that is, if impacted between the impact head and the "length of need" (where the "length of need" is considered to be the distance from the terminal end to where the guardrail will redirect a vehicle during an angled impact) during an angled impact, the terminal end will gate and allow the errant vehicle to pass to the back side of the terminal end. However this gating effect may have undesirable or unsafe results, and preferably an improved or safer or varied energy absorbing system is utilised to control errant vehicle barrier/guardrail impacts.

It is therefore an object of the present invention to provide a guardrail and/or guardrail impact head which will go at least some way towards addressing the foregoing problems or which will at least provide the industry with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

DISCLOSURE OF INVENTION

In a first aspect, the invention may broadly be said to consist in a frangible post for a guardrail, wherein the post is of single piece construction and comprises:

- at least two first post members which in use are vertically oriented, and which define first and second parallel plans, and
- a second post member which has an outer surface defining a third plane which connects the two first post members to one another,
  - wherein the first and second vertical planes of the first post members, are substantially orthogonal to the third vertical plane of the second member, wherein in use the post is positioned so the first and second vertical planes of the first post members are substantially parallel to the direction of traffic flowing past the guardrail,
- wherein the first post members have a region of weakness defined by a notch formed solely in each vertical edge of said first post members on periphery of said first and second vertical planes such that the region of weakness bisects the first post members in a horizontal plane substantially orthogonal to both the first, second and third planes spanning between the notches.

Preferably the first and second members are integral or welded together.

Preferably, the first and second members are connected in one of the following configurations: an L-beam, an I-beam, an X-beam or a T-beam.

Preferably, two first members are connected to said second member in an I-beam configuration.

Preferably, the post is sunk into the ground, with the at least one region of weakness being near or at ground level.

Preferably, rotation of the bar member from said first orientation to said second orientation ensures that the cable follows a tortuous pathway.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

This invention is designed to be a substantially non-gating guardrail, meaning that at any point along the side of the guardrail from the terminal end onwards, an impacting vehicle on an angled collision may be substantially redirected away from its initial impact trajectory. It is also designed to substantially absorb energy during an end on impact to the terminal end.

"Gating" is a term used within the guardrail industry to refer to sections of guardrail which are unable to withstand high impact side angle collisions, and significant guardrail deformation or ultimate failure or breakage may occur.

Figure 1:
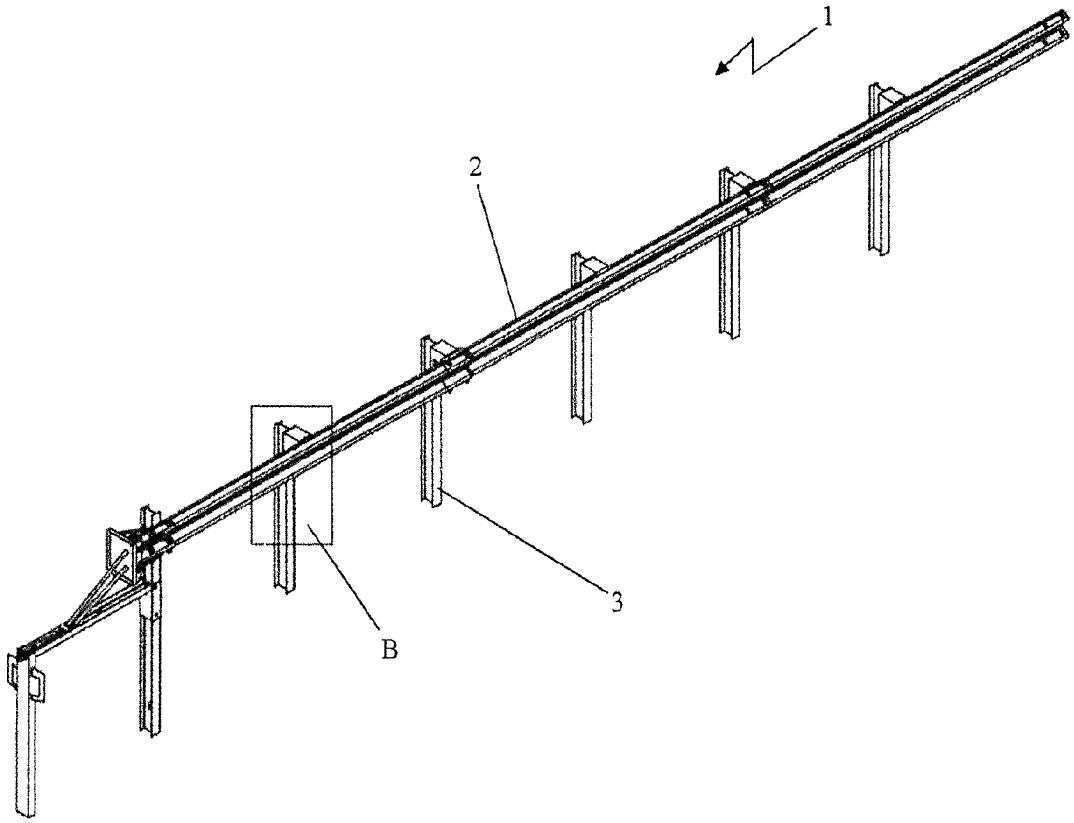
FIG. 1: is a perspective view of one embodiment of a guardrail according to the present invention.
Figure 2:
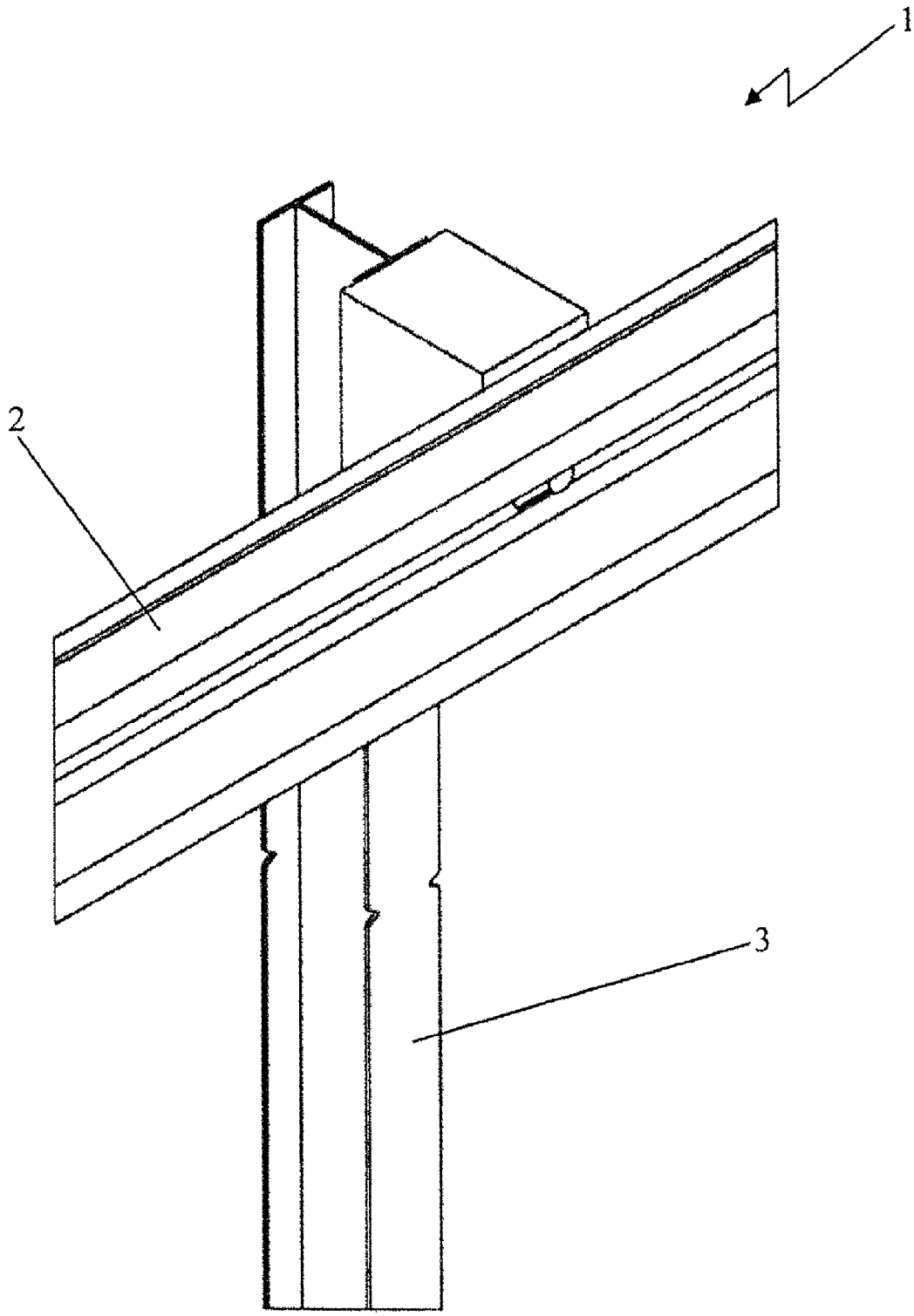
FIG. 2: shows an enlarged view of the guardrail in FIG. 1 in the area demarcated by box B.

In relation to FIGS. 1 and 2 there is provided a guardrail 1 having a number of rails 2 which are supported by posts 3 in the form of I-beams.

Figure 3:
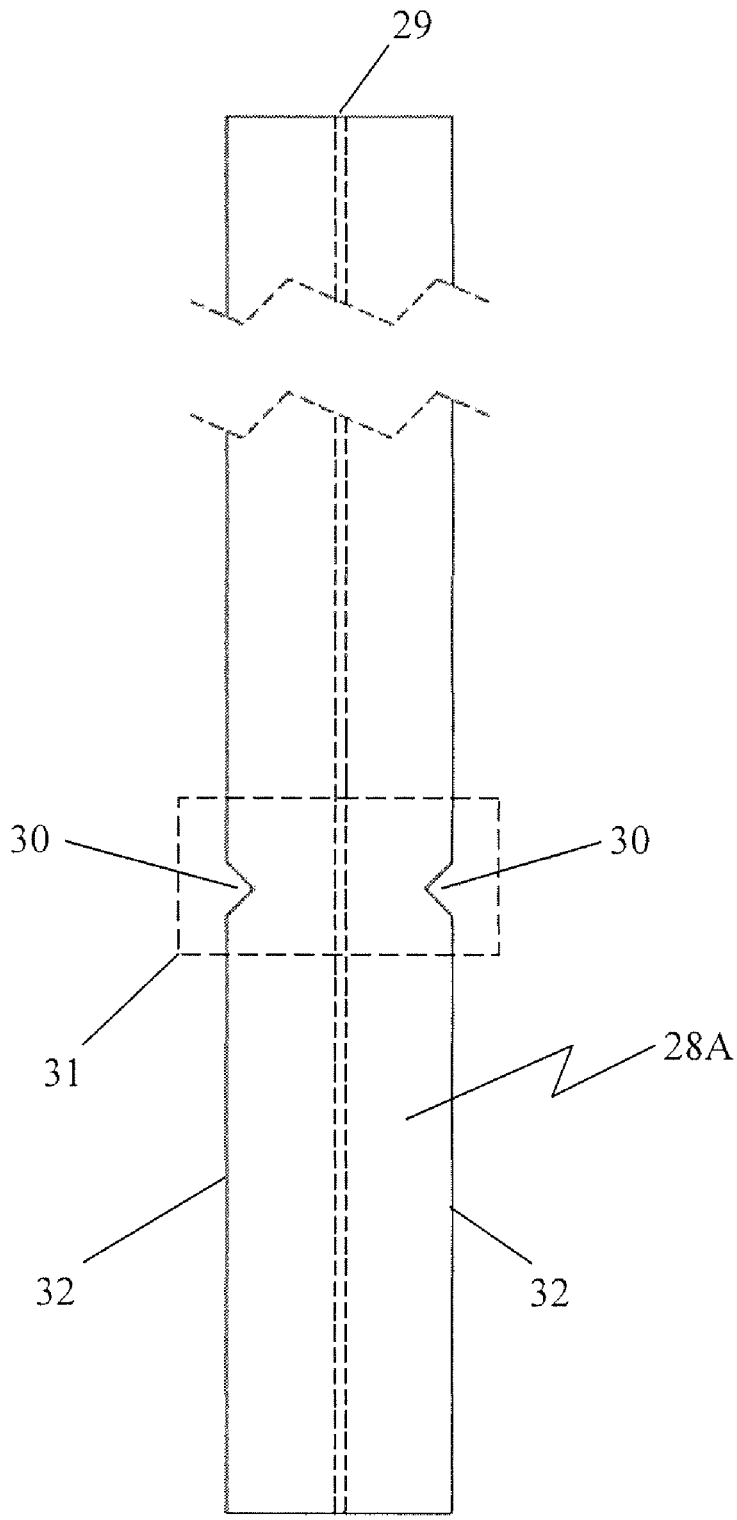
FIG. 3: is a front elevational view of a frangible post in accordance within the present invention.
Figure 4:
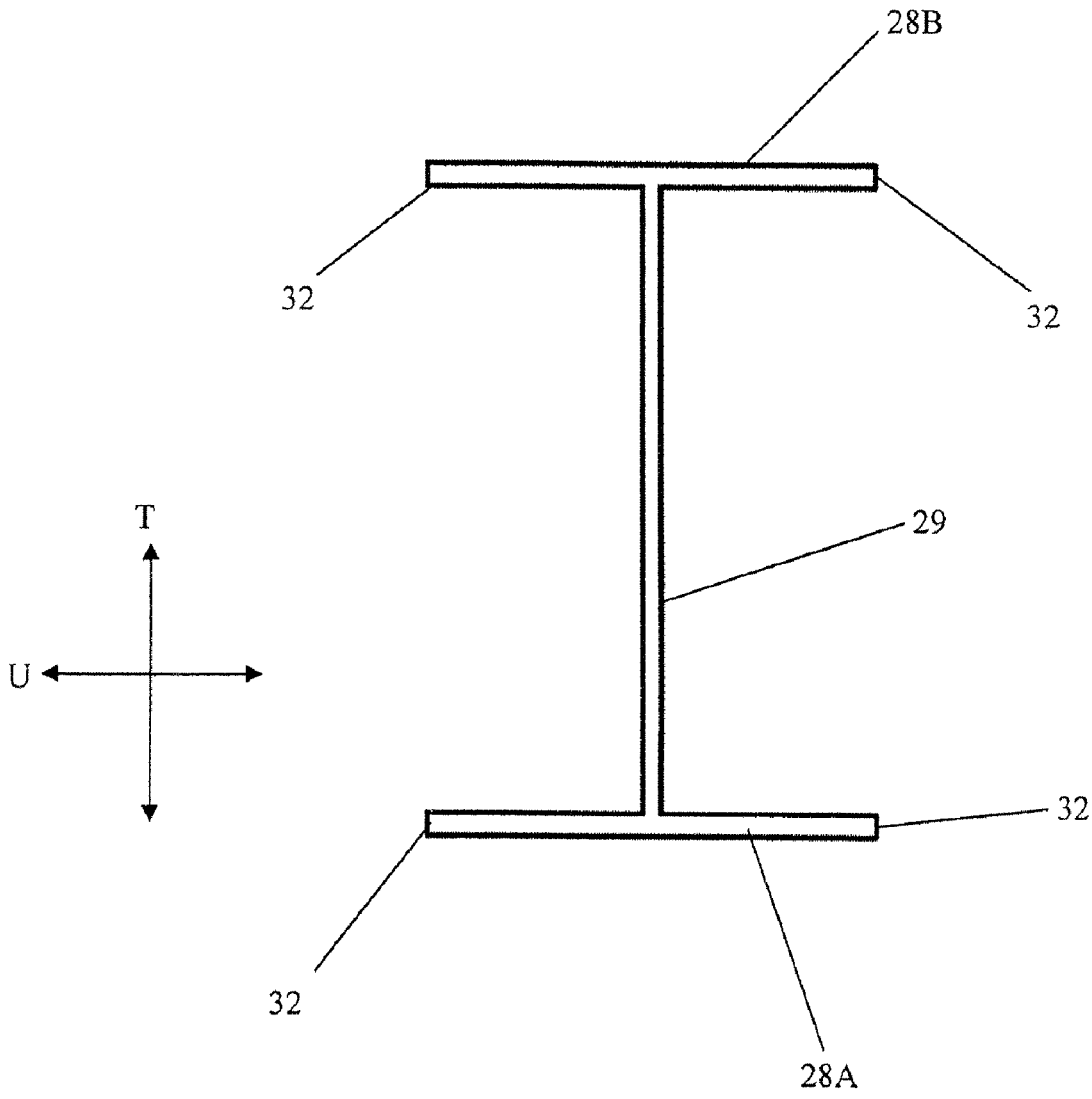
FIG. 4: is a plan view of the frangible post of FIG. 3.

In particular, a frangible post construction as illustrated in FIGS. 2-4 may be especially suitable for re-directing an errant side-impacting vehicle back onto the road. The frangible post 3 has two first members 28A and 28B and a second member 29 which orthogonally connects the two first members 28A, 28B. The first members 28A and 28B have at least one region of weakness shown in relation to 28A by dotted box line 31. The region of weakness created by notches 30 located on vertical edges 32 of post members 28A and 28B. The notches 30 on post members 28A and 28B are located in the same plane, thereby providing a region of weakness 31 bisecting the first post members 28A and 28B and second post member 29 there between. Advantageously, this configuration allows a substantially frangible or weakened region to exist in the first members which may be more likely to be structurally affected during an impact, in direction U which would be a head on impact with the associated guardrail 1 (i.e. an impact along the longitudinal axis of the guardrail 1). In contrast, an impact in line with the plane of the second member 29 (which is transverse to the longitudinal axis of the guardrail (i.e. in direction T)) will require a greater force of impact to structurally affect the second member or post. Thereby enabling the guardrail to redirect vehicles which impact with the side of the guardrail to keep the vehicle on the road.

In other words, because the first member is weakened in relation to an impact in a first direction and the second member has effectively no structural resistance to a force in that direction, the post will tend to bend or break at the weakened region when subjected to that force. In contrast, when impacted by a force substantially perpendicular to the first direction, the region of weakness in the first member has little effect on the frangibility of the post and the second member offers substantial resistance to deflection in that direction.

The first and second members need not be attached to one another at exactly 90°, however this orientation may be most suitable for use with a guardrail where impacts are generally received either in-line with the longitudinal axis of the guardrail, or substantially perpendicular to the guardrail.

The frangible post is designed to more easily structurally fail in an impact from a direction substantially in line with the longitudinal axis of the guardrail than in an impact substantially perpendicular to the guardrail.

The at least one region of weakness can be formed by a cut-away section 30 from the first members, or other similar notches or portions of the first member being removed. The configuration chosen may depend on the post geometry required by a user. The first and second members are preferably integrally formed or welded together.

Ideally, each post is sunk into the ground, with the at least one region of weakness being at or near to ground level; which allows the post to break off at or near ground level during a post failure impact.

For example, an I-beam configuration of the post as illustrated in FIGS. 1-4, should be aligned so that the first members 28A and 28B are parallel with the road (and therefore guardrail). Each edge of the first member having a 12 mm deep triangular notch removed from the first member, the first member of which has dimensions (excluding length) is about 100 mm in width, and of about 20 mm thickness. Such notches should preferably be made so that they are approximately 50 mm below ground level (after the post has been "sunk").

During an impact in an axial direction to the guardrail, a tear in the first member starts in the upstream note from the impact, while the downstream notch allows the first member to collapse and/or fail.

Preferably, the guardrail as described above may be utilised in applications where protective barriers are required to separate vehicle traffic flow from each other, or safety to pedestrians from vehicles, or even to protect vehicles running off roads. It is desirable that the guardrail as described provides a non-gating design and which re-directs an errant vehicle from its correct path back onto a road or at least away from pedestrians on a footpath.

The guardrail as described goes at least some way toward facilitating a system for controllably slowing a vehicle during an end-on barrier impact, as well as some way towards preventing the guardrail from gating during a side angled impact. It is also preferable that the "length of need" is substantially reduced compared to various existing technologies, and may most preferably have a length of need of almost zero distance.

The guardrail as described may be utilised to form a part of whole of a guardrail system, although this system in particular may be applied to the terminal ends of a required guardrail or barrier or be substantially retrofitable to existing guardrails.

Aspects of the present invention have been described by way of example only and it should be appreciated that modifications and additions may be made thereto without departing from the scope of the appended claims.

The invention claimed is:

1. A frangible post for a guardrail, wherein the post is of a single piece construction and comprises:

at least two first post members which, in use, are vertically oriented, and which define first and second parallel planes; and a second post member which has an outer surface defining a third plane which connects the first two post members to one another, wherein the first and second vertical planes of the first post members, are substantially orthogonal to the third vertical plane of the second member, wherein in use the post is positioned so the first and second vertical planes of the first post members are substantially parallel to the direction of traffic flowing past the guardrail, wherein said first post members have a region of weakness defined by a notch formed solely in each vertical edge of said first post members on the periphery of said first and second vertical planes such that the region of weakness bisects said first post members in a horizontal plane substantially orthogonal to both the first, second, and third planes spanning between said notches.

2. A frangible post for a guardrail as claimed in claim 1, wherein the first and second post members are integral or welded together.

3. A frangible post for a guardrail as claimed in claim 1, wherein said two first post members are homogeneously constructed to be connected to said second post member in an I-beam configuration.

4. A frangible post for a guardrail as claimed in claim 1, wherein the region of weakness is located near or at ground level, while the post is in use.

5. A frangible post for a guardrail as claimed in claim 1, wherein the frangible post retains tensile strength upon an impact at a substantially perpendicular angle to the guardrail.

6. A frangible post for a guardrail as claimed in claim 1, wherein the frangible post structurally fails upon an impact that is directed substantially inline with the longitudinal axis of the guardrail.

7. A frangible post for a guardrail as claimed in claim 1, wherein each said notch is wedge-shaped defining a point, and said region of weakness is a line defined between said points.

8. A frangible post for a guardrail as claimed in claim 1, wherein said region of weakness remains homogeneous with each said first member until receipt of a shock impact sufficient to fracture said first member in said region between said notches.

9. A guardrail including a post as claimed in claim 1.

10. A guardrail as claimed in claim 9, wherein the first and second post members are integral or welded together.

11. A guardrail as claimed in claim 9, wherein said two first post members are homogeneously constructed to be connected to said second post member in an I-beam configuration.

12. A guardrail as claimed in claim 9, wherein the region of weakness is located near or at ground level, while the post is in use.

13. A guardrail as claimed in claim 9, wherein the frangible post retains tensile strength upon an impact at a substantially perpendicular angle to said guardrail.

14. A guardrail as claimed in claim 9, wherein the frangible post structurally fails upon an impact that is directed substantially inline with the longitudinal axis of said guardrail.

15. A guardrail as claimed in claim 9, wherein each said notch is wedge-shaped defining a point, and said region of weakness is a line defined between said points.

16. A guardrail as claimed in claim 9, wherein each said notch is generally V-shaped and generally recessed from said outer surface of said corresponding first post member.

17. A guardrail as claimed in claim 16, wherein said notch is positioned such that a tip of said V-shaped notch is recessed further than a wide-end opening of said V-shaped notch.

18. A frangible post as claimed in claim 1, wherein each said notch is generally V-shaped and generally recessed from said outer surface of said corresponding first post member.

19. A frangible post as claimed in claim 1, wherein said notch is positioned such that a tip of said V-shaped notch is recessed further than a wide-end opening of said V-shaped notch.

20. A guardrail having a plurality of frangible posts supporting a railing extending in a direction that is parallel to a flow of traffic thereby, each post comprising:

a first vertical planar post member having two opposite vertical faces that are orthogonal to the first direction, each of said two opposite vertical faces of said first member having a V-shaped notch extending horizontally there across;

a second vertical planar post member having a first and second vertical slide opposite one another, the second member orthogonally connected by the first vertical side to a vertical midline of the first member, the second member being free of V-shaped notches;

a third vertical planar post member having two opposite vertical faces that are orthogonal to the first direction, each of said two opposite vertical faces of said second member having a V-shaped notch extending horizontally there across, the second member orthogonally connected by the second vertical side to a vertical midline of the third member, such that the first, second, and third members form an I-beam of unitary one-piece construction; and whereby the four V-shaped notches lie in a common horizontal plane to define a region of weakness that causes failure of the first and second members when impacted by an automobile.

21. A guardrail as claimed in claim 20, wherein the post members are welded together.

22. A guardrail as claimed in claim 20, wherein said notch is positioned such that a tip of said V-shaped notch is recessed further than a wide-end opening of said V-shaped notch.

* * * * *